US009062478B2

(12) United States Patent
Bingle et al.

(10) Patent No.: US 9,062,478 B2
(45) Date of Patent: Jun. 23, 2015

(54) DOOR HANDLE ASSEMBLY

(75) Inventors: Robert Bingle, Walker, MI (US); Jerry Cummins, Portland, MI (US)

(73) Assignee: ADAC Plastics, Inc., Grand Rapids, MI (US)

( * ) Notice: Subject to any disclaimer, the term of this patent is extended or adjusted under 35 U.S.C. 154(b) by 335 days.

(21) Appl. No.: 13/208,743

(22) Filed: Aug. 12, 2011

(65) Prior Publication Data

US 2012/0119524 A1 May 17, 2012

Related U.S. Application Data

(60) Provisional application No. 61/373,641, filed on Aug. 13, 2010.

(51) Int. Cl.

| | |
|---|---|
| ***E05B 3/00*** | (2006.01) |
| ***E05B 81/78*** | (2014.01) |
| ***E05B 81/28*** | (2014.01) |
| *E05C 1/06* | (2006.01) |
| *E05B 81/06* | (2014.01) |
| *E05B 85/10* | (2014.01) |

(52) U.S. Cl.

CPC ..... *E05B 81/78* (2013.01); *E05B 81/06* (2013.01); *E05B 81/28* (2013.01); *E05B 85/103* (2013.01); *E05B 85/107* (2013.01)

(58) Field of Classification Search

CPC ..... Y10S 292/31; E05B 5/00; Y10T 16/458
USPC ..... 292/1, 336.3, DIG. 31, 194, 219, 201; 16/412

See application file for complete search history.

(56) References Cited

U.S. PATENT DOCUMENTS

| | | | | |
|---|---|---|---|---|
| 5,123,687 | A * | 6/1992 | Pfeiffer et al. | 292/336.3 |
| 5,530,990 | A * | 7/1996 | Chen | 16/113.1 |
| 6,386,599 | B1 * | 5/2002 | Chevalier | 292/201 |
| 6,406,075 | B1 * | 6/2002 | Rice et al. | 292/336.3 |
| 6,450,554 | B1 * | 9/2002 | Rotondi et al. | 292/158 |
| 6,490,896 | B2 * | 12/2002 | Segawa | 70/208 |
| 6,575,508 | B2 * | 6/2003 | Stuart et al. | 292/336.3 |
| 6,588,813 | B1 * | 7/2003 | Marcarini et al. | 292/347 |
| 6,843,085 | B2 * | 1/2005 | Dimig | 70/237 |
| 7,059,641 | B2 * | 6/2006 | Chanya | 292/336.3 |
| 7,108,301 | B2 * | 9/2006 | Louvel | 292/336.3 |
| 7,232,164 | B2 * | 6/2007 | Lee | 292/336.3 |
| 7,905,530 | B2 * | 3/2011 | Browne et al. | 296/1.02 |
| 8,141,204 | B2 * | 3/2012 | Chiang | 16/113.1 |
| 8,250,889 | B2 * | 8/2012 | Zagoroff | 70/279.1 |
| 8,282,142 | B2 * | 10/2012 | Fannon | 292/336.3 |
| 8,443,553 | B1 * | 5/2013 | Polewarczyk et al. | 49/503 |
| 8,690,204 | B2 * | 4/2014 | Lang et al. | 292/336.3 |
| 8,701,353 | B2 * | 4/2014 | Patel et al. | 49/503 |

(Continued)

*Primary Examiner* — Kristina Fulton
*Assistant Examiner* — Faria Ahmad
(74) *Attorney, Agent, or Firm* — Dickinson Wright PLLC

(57) ABSTRACT

A handle assembly for a vehicle door, comprising a body supporting a handle that is pivotally moveable between a stowed position and a deployed position, and an actuator assembly comprising a motor and an actuator member interposed between the motor and the handle. The actuator member is operably coupled to the handle and moveable by the motor to effect movement of the handle between the stowed and deployed positions thereof. The actuator member has an accumulator compressible under the force of the motor when an external obstruction acts on the handle in the stowed position thereof to prevent the handle from being moved to the deployed position thereof.

20 Claims, 9 Drawing Sheets

(56) References Cited

U.S. PATENT DOCUMENTS

2003/0019261 A1* 1/2003 Wittwer ..... 70/257
2005/0280266 A1* 12/2005 Mueller et al. ..... 292/336.3
2006/0152017 A1* 7/2006 Powell ..... 292/1
2007/0069531 A1* 3/2007 Herbert et al. ..... 292/336.3
2007/0120382 A1* 5/2007 Chevalier ..... 292/336.3
2010/0127516 A1* 5/2010 Fannon ..... 292/336.3
2011/0025074 A1* 2/2011 Reznar ..... 292/33
2011/0148575 A1* 6/2011 Sobecki et al. ..... 340/5.64
2013/0127185 A1* 5/2013 Lang et al. ..... 292/336.3
2014/0083016 A1* 3/2014 Schryer ..... 49/460

* cited by examiner

DOOR HANDLE ASSEMBLY

CROSS-REFERENCE TO RELATED APPLICATIONS

This application is related to, and claims the benefit of priority from, U.S. Provisional Application Ser. No. 61/373,641, filed 13 Aug. 2010, the disclosure of which is incorporated herein by reference in its entirety.

FIELD OF THE INVENTION

The present invention relates to a handle assembly for a vehicle door, and more particularly to such a handle assembly wherein the handle is moveable by means of a motor between stowed and deployed positions.

BACKGROUND

In vehicles, and especially automobiles, it is known to provide door handles that are moveable between a first, stowed condition in which the handle is essentially flush with the exterior surface of the door and generally inaccessible to a user, and a second, deployed condition in which the handle is pivoted so that a portion thereof extends away from the door so as to be accessible to, and actuatable by, a user to open the vehicle door. Presently, such "flush-mount" handles are manually pivotable, requiring the user to physically depress one area of the handle in order to pivot the handle from the stowed to the deployed positions thereof.

SUMMARY OF THE DISCLOSURE

The specification discloses a handle assembly for a vehicle door, comprising a body supporting a handle that is pivotally moveable between a stowed position and a deployed position, and an actuator assembly comprising a motor and an actuator member interposed between the motor and the handle. The actuator member is operably coupled to the handle and moveable by the motor to effect movement of the handle between the stowed and deployed positions thereof. The actuator member has an accumulator compressible under the force of the motor when an external obstruction acts on the handle in the stowed position thereof to prevent the handle from being moved to the deployed position thereof.

In one aspect of the invention, the handle is comprised of mateable outer and inner handle portions.

In another aspect, one or more sensors, such as a capacitive sensor, are disposed between the mateable inner and outer handle portions.

In another aspect, in the stowed position thereof, the handle is received in a recess provided in the body. The recess may be surrounded by a gasket to seal the handle assembly against the interior of a vehicle door panel.

In a still further aspect, the motor is disposed on the body.

According to yet another aspect of the invention, the actuator assembly comprises a pin that is reciprocally driven by the motor, the actuator member being connected to the pin; and a bell-crank pivotally secured to the body, the bell-crank connected to each of the actuator member and the handle.

In a still further aspect, the bell-crank defines a first opening for slidably receiving therein a stem portion projecting away from the handle.

In another aspect, the accumulator is a spring disposed along a length of the actuator.

In another aspect, the invention comprehends a flush-mount handle assembly for a vehicle door of the type including a door panel having exterior and interior surfaces, and an opening therethrough for providing access to the handle assembly, the handle assembly comprising a body adapted for securement to the interior surface of the vehicle door panel proximate the opening, a handle that is connected to the body and pivotally moveable relative thereto between a stowed position, in which the handle is disposed in close proximity to the body portion, and a deployed position, in which the handle projects away from the body portion, and an actuator assembly comprising a motor and an actuator member interposed between the motor and the handle. The actuator member operably coupled to the handle and moveable by the motor to effect movement of the handle between the stowed and deployed positions thereof. The actuator member has an accumulator compressible under the force of the motor when an external obstruction acts on the handle in the stowed position thereof to prevent the handle from being moved to the deployed position thereof.

In another aspect, the invention comprehends a handle assembly for a vehicle door of the type including a door panel having exterior and interior surfaces, and an opening therethrough for providing access to the handle assembly, the handle assembly comprising a body securable to the interior surface of the vehicle door panel proximate the opening, a handle that is connected to the body and pivotally moveable relative thereto between a stowed position, in which the handle is disposed in close proximity to the body portion, and a deployed position, in which the handle projects away from the body portion, and an actuator assembly comprising a motor, an actuator member having a first end operably coupled to the motor and a second end coupled to the handle via a bell-crank, the actuator member moveable by the motor to effect movement of the handle between the stowed and deployed positions thereof. The actuator member has a spring accumulator compressible under the force of the motor when an external obstruction acts on the handle in the stowed position thereof to prevent the handle from being moved to the deployed position thereof.

BRIEF DESCRIPTION OF THE DRAWINGS

For a better understanding of the present invention and to show more clearly how it may be carried into effect, reference will now be made, by way of example, to the accompanying drawings, in which.

WRITTEN DESCRIPTION

As required, a detailed description of an exemplary embodiment of the present invention is disclosed herein. However, it is to be understood that the disclosed embodiment is merely exemplary of the invention, which may be embodied in various and alternative forms. The accompanying drawings are not necessarily to scale, and some features may be exaggerated or minimized to show details of particular components. Therefore, specific structural and functional details disclosed herein are not to be interpreted as limiting, but merely as a providing a representative basis for teaching one skilled in the art to variously employ the present invention.

Figure 1:
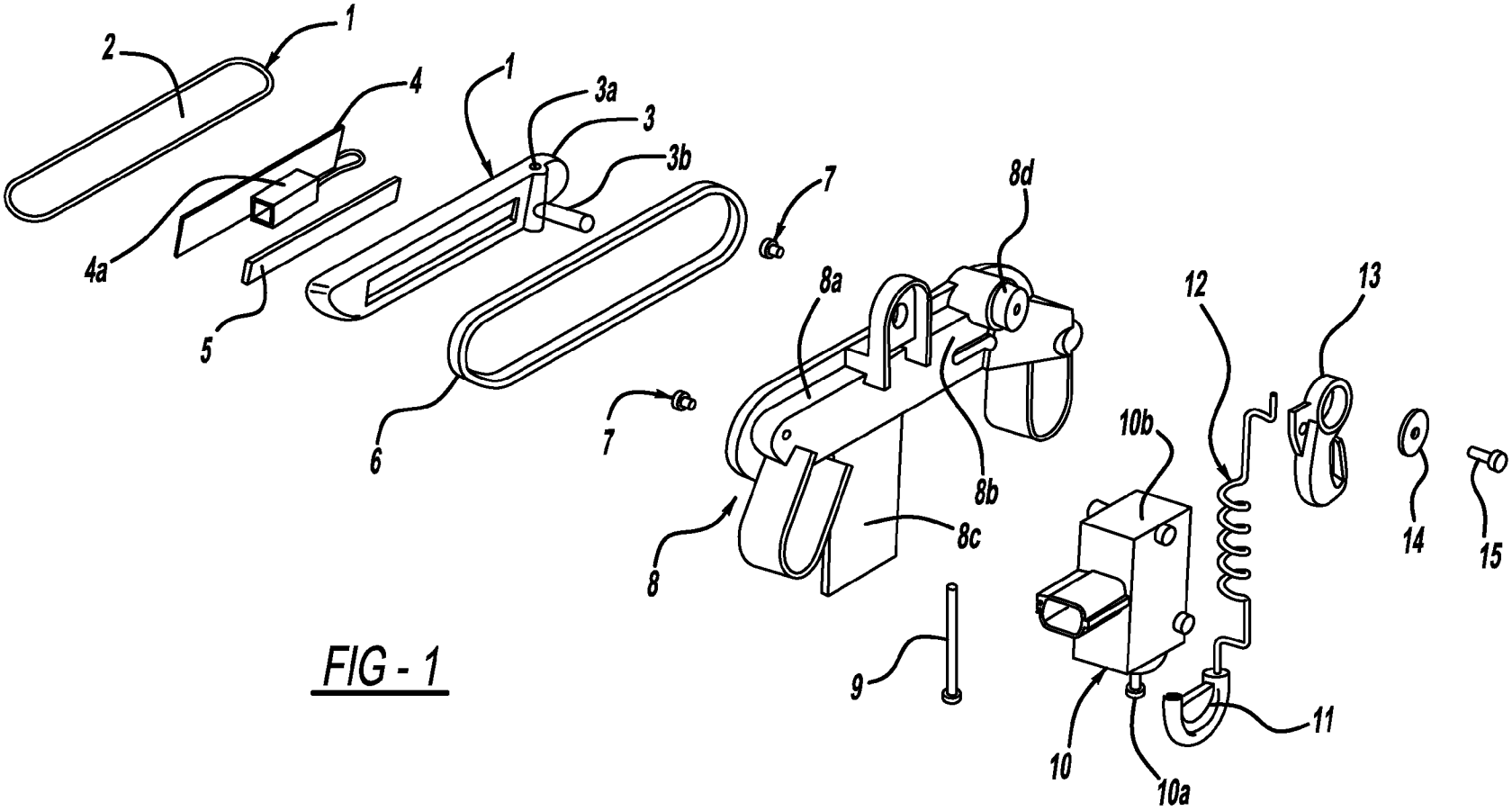
FIG. 1 is an exploded perspective view of the door handle assembly of the present invention.
Figure 8:
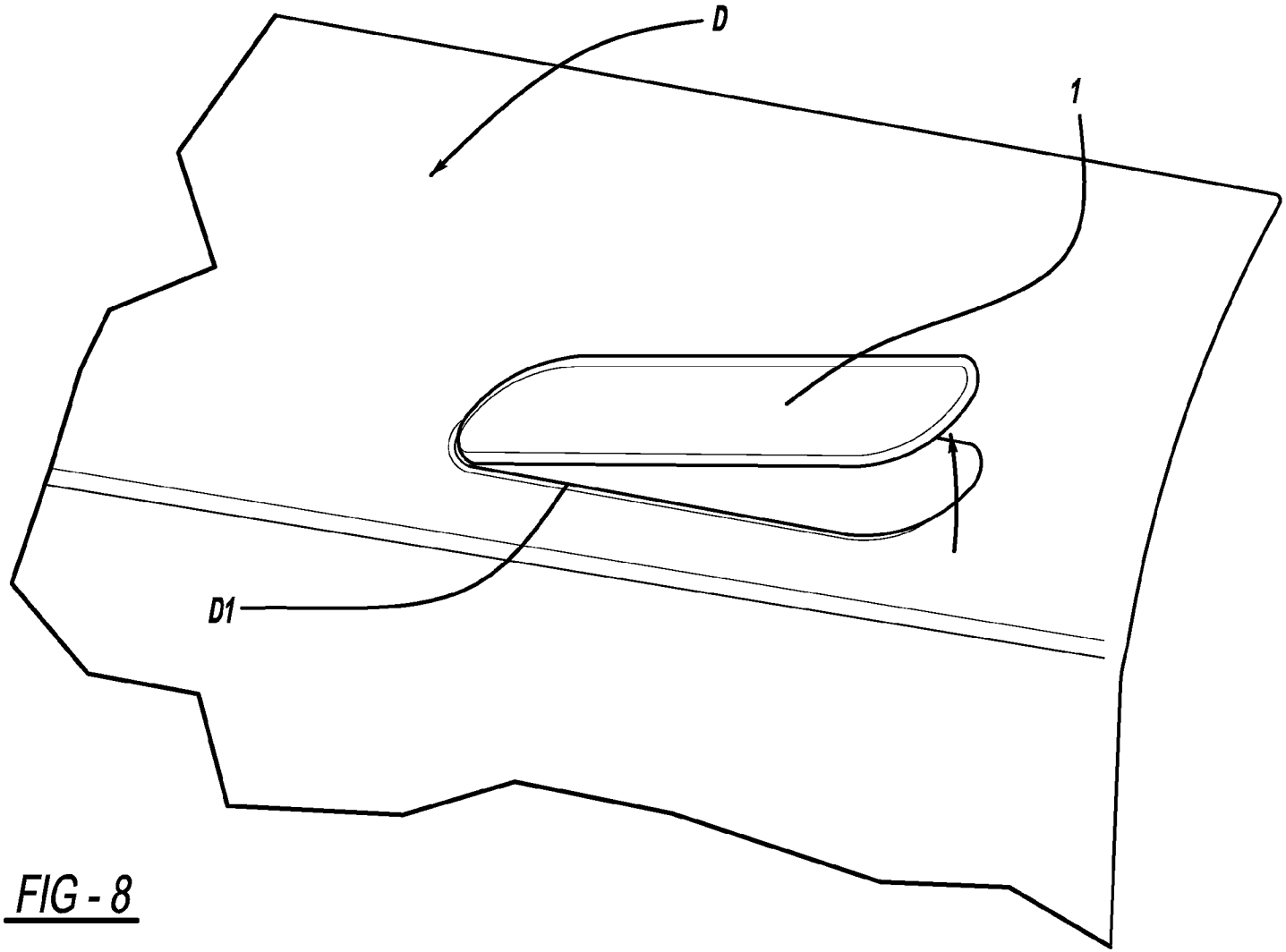
FIG. 8 is a detailed view of the exterior of an exemplary vehicle door mounting the handle assembly of the present invention, with the handle shown in the deployed position.

Turning now to FIG. 1, the present invention according to an exemplary embodiment may be seen to encompass a handle assembly for a vehicle door (not shown in FIG. 1), the handle assembly generally comprising a body 8 supporting a handle 1 that is pivotally moveable between a stowed position (not shown in FIG. 1, shown in FIG. 4), in which the handle is generally flush with the exterior surface of a vehicle door, and a deployed position (not shown in FIG. 1, shown in FIG. 8), in which the handle is pivoted so that a portion thereof extends away from the door so as to be actuatable by a user. Further, the handle assembly generally comprises an actuator assembly for moving the handle 1 between the stowed and deployed positions thereof, the actuator assembly comprising a motor 10 and an actuator member 11 interposed between the motor 10 and the handle 1 and operably coupled to the handle 1. As described further herebelow, the actuator member 11 has an accumulator spring 12 that is compressible under the force of the motor 10 when an external obstruction (created, for instance, by ice built-up around the handle on the exterior of the vehicle door, a person leaning against the vehicle door and handle, etc.) acts on the handle 1 in the stowed position thereof to prevent the handle from being moved to the deployed position thereof.

With continuing reference to FIG. 1, the handle 1 of the present invention comprises, according to the illustrated embodiment, two mateable portions: An outer handle portion 2 and an inner handle portion 3. Between these portions 1, 3 is disposed a printed circuit board ("PCB") 4 including one or more sensors and one or more LEDs, as well as a lens 5. According to this embodiment, there may optionally be provided a sensor facilitating authentication of a user-possessed, wireless communication device (such as may be built into a key fob, card, etc.) when the user is in a given proximity of the sensor. The sensor may be part of the PCB 4 or, alternatively, may be provided elsewhere on the vehicle. Communication may be via any known wireless protocol. In response to authentication, a signal is sent (such as, for instance, via the vehicle's master control unit or by direct communication between the PCB 4 and motor 10) which results in actuation of motor 10 to effect movement of the handle 1 to the deployed position thereof. At this point, the vehicle may or may not also be unlocked. PCB 4 preferably, though not necessarily, includes a touch sensor operative to detect when a user grasps the handle 1 in the deployed position thereof. Lens 5 is provided to facilitate the touch sensor's detection of a user grasping the handle 1. When the user grasps the handle, the touch sensor sends a signal to unlatch and unlock (if the vehicle is still locked) the vehicle door, thereby permitting the user to open the door. According to the illustrated embodiment, PCB 4 comprises a touch sensor connectable, via a wiring harness 4*a*, to an electronic door latch (not shown).

Alternatively, for example and without limitation (the particular unlocking and unlatching means not comprising part of the present invention), the handle may actuate a mechanical latching mechanism of conventional construction, and according to which user actuation of the handle effects, such as through a bellcrank, movement of a latch rod which effects corresponding movement of a latch lever to actuate the latching mechanism. According to such a mechanical embodiment, it will be appreciated that a touch sensor such as described above need not, but may (for instance to effect unlocking of the vehicle), be included.

PCB 4 may, as noted, be further provided with one or more LEDs which can be actuated by any of the one or more sensors and/or the vehicle's master control unit in order to provide visual indication of any one or more of the vehicle's locked/unlocked status, authentication of the user's communication device, etc.

Of course, it is contemplated that the present invention may alternatively comprise a monolithic handle, and/or that movement of the handle between the stowed and deployed conditions thereof may be effected by other than a sensor as described herein, such features being exemplary only.

The handle 1, whether comprised of one or more portions, may be made of any suitable material, including one or more metals, polymers, etc., or any combination thereof, according to known methods.

Figure 2:
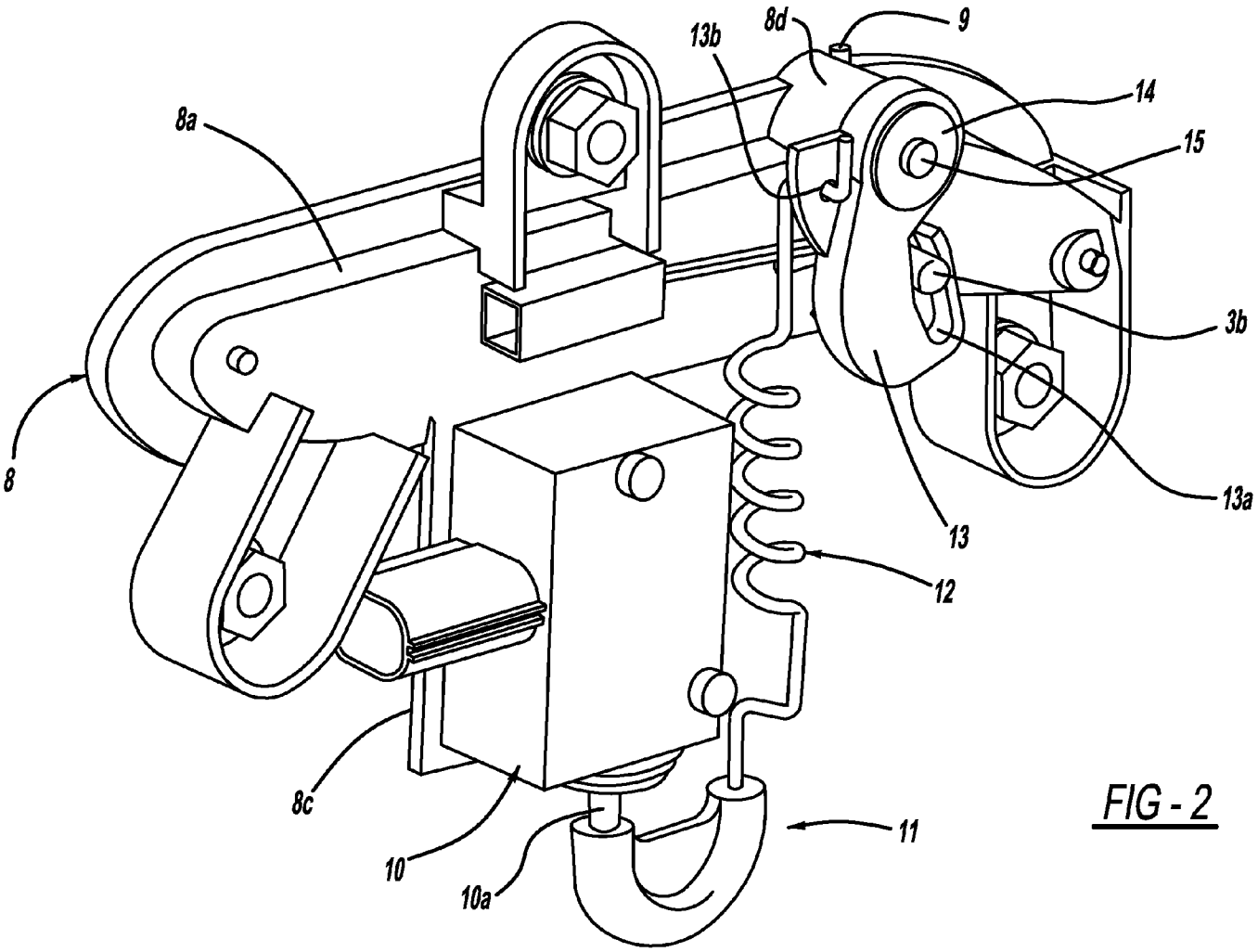
FIG. 2 is rear-view of the assembled door handle assembly of the present invention.

Referring to FIGS. 1 and 2, the handle 1 is received in a correspondingly shaped recess 8*a* (visible in FIGS. 1 and 2 only from the rear surface of the body 8) provided in a first surface of body 8 (which may, for instance, be a monolithic or multi-part element (a monolithic element is shown) fashioned from a suitable polymer). More particularly according to the illustrated embodiment, inner handle portion 3 is pivotally secured to the body 8 by means of a pivot pin 9 passing through opening 3*a*.

As best shown in FIG. 1, inner handle portion 3 includes an inwardly (i.e., toward the body 8) projecting stem portion 3*b* that is received through a slot 8*b* defined through the back wall of the handle-receiving recess 8*a*.

Rubber bumpers 7 may optionally be disposed in the handle-receiving recess 8*a* to dampen the noise created by the handle 1 contacting the body 8 as the handle is moved between the stowed and deployed positions thereof.

Figure 3:
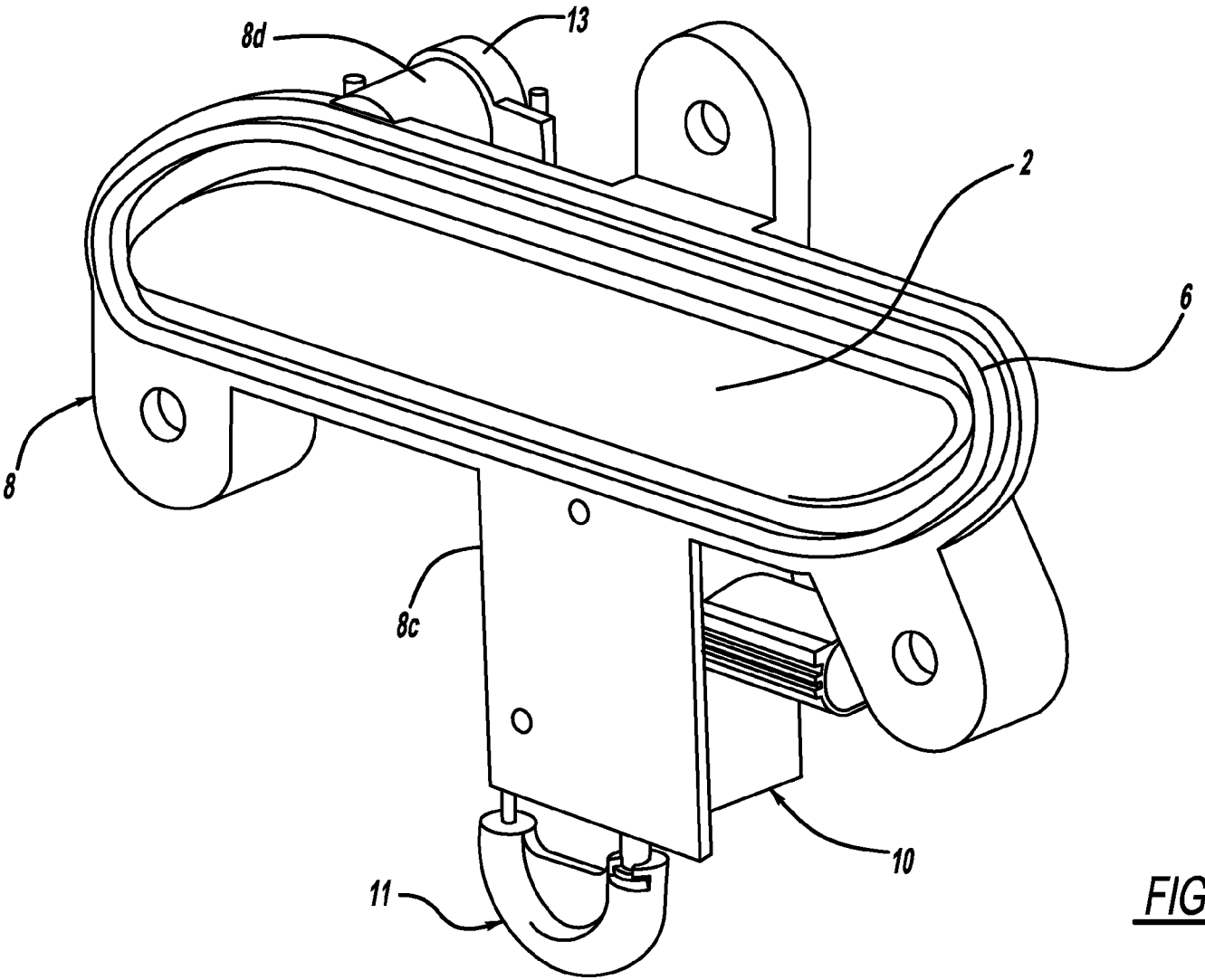
FIG. 3 is front-view of the assembled door handle assembly of FIG. 2.

As shown in FIGS. 1 and 3, a seal member, such as the illustrated foam gasket 6, may be provided on the body 8 about the periphery of the handle-receiving recess. As will be appreciated from the remainder of this disclosure, gasket 6 functions to seal the handle assembly against the interior of a vehicle door panel (not shown in FIGS. 1 and 3) to prevent moisture and debris from entering the interior of the vehicle door via the opening therein provided for the handle 1.

Motor 10 is, as shown in FIGS. 1 through 2, supported on a support surface 8*c* of body 7.

Referring now to FIGS. 1 through 3, the actuator assembly will now be more fully described. Actuator member 11 is connected at one end thereof to a reciprocating pin 10*a* driven by the motor 10. At its opposite end, actuator member 11 is operably connected to the inner handle portion 3 via a bell-crank element 13. Bell-crank 13 is pivotally secured (by means of a washer 14 and fastener 15) to a mount 8*d* defined on the body 8. Bell-crank 13 defines a first opening 13*a* for slidably receiving therein stem portion 3*b* of the inner handle portion 3, and a second opening 13*b* for receiving the end of actuator member 11.

Still referring to FIGS. 1 and 2, actuator member 11 will be seen to include along its principal length accumulator spring 12. As described further herebelow, accumulator spring 12 is compressible under the force of the motor 10 when an external obstruction (created, for instance, by ice built-up around the handle on the exterior of the vehicle door, an individual leaning against the door and the door handle, etc.) acts on the handle 1 in the stowed position thereof to prevent the handle from being moved to the deployed position thereof.

Figure 4:
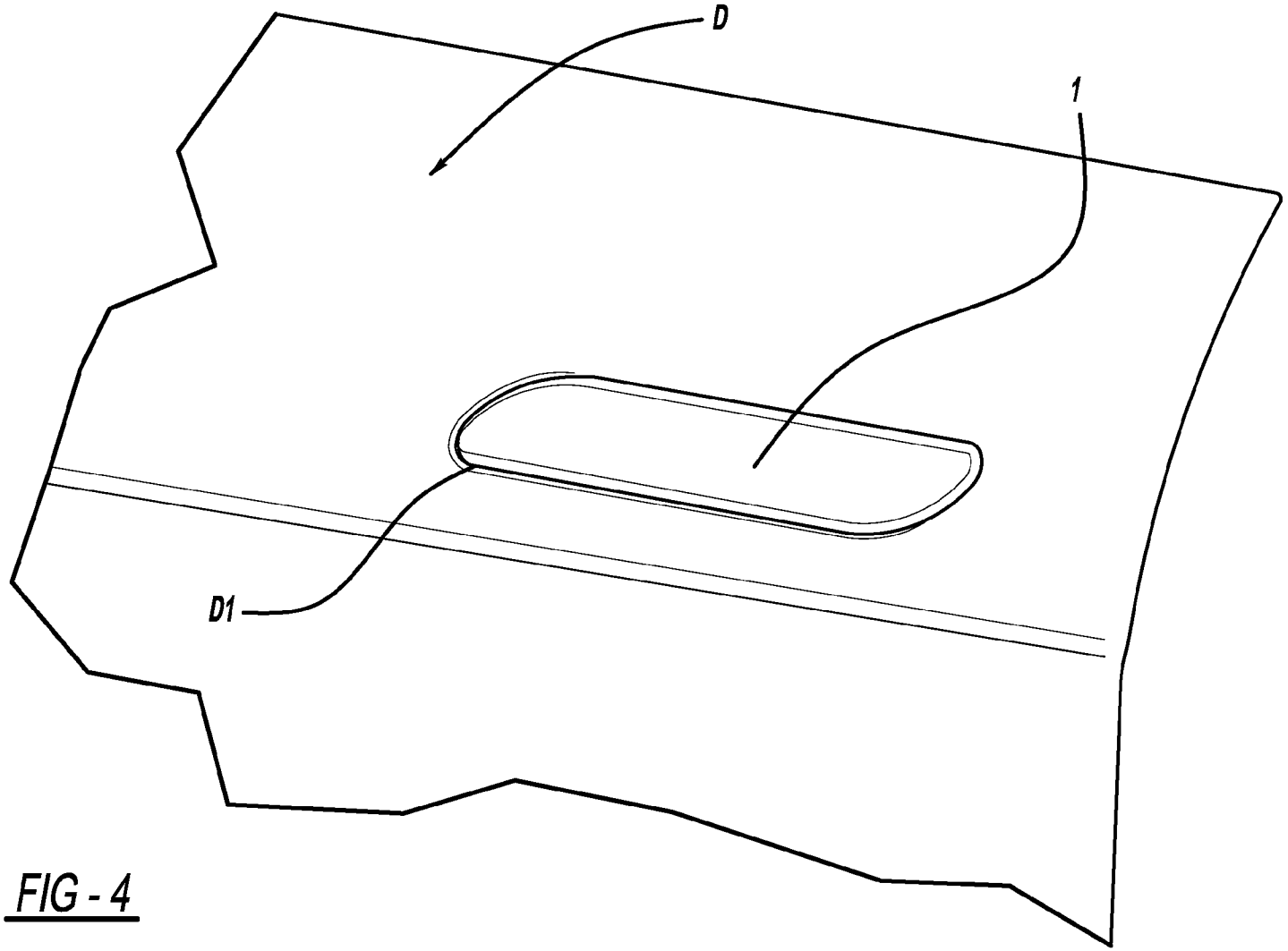
FIG. 4 is a detailed view of the exterior of an exemplary vehicle door mounting the handle assembly of the present invention, with the handle shown in the stowed position.
Figure 5:
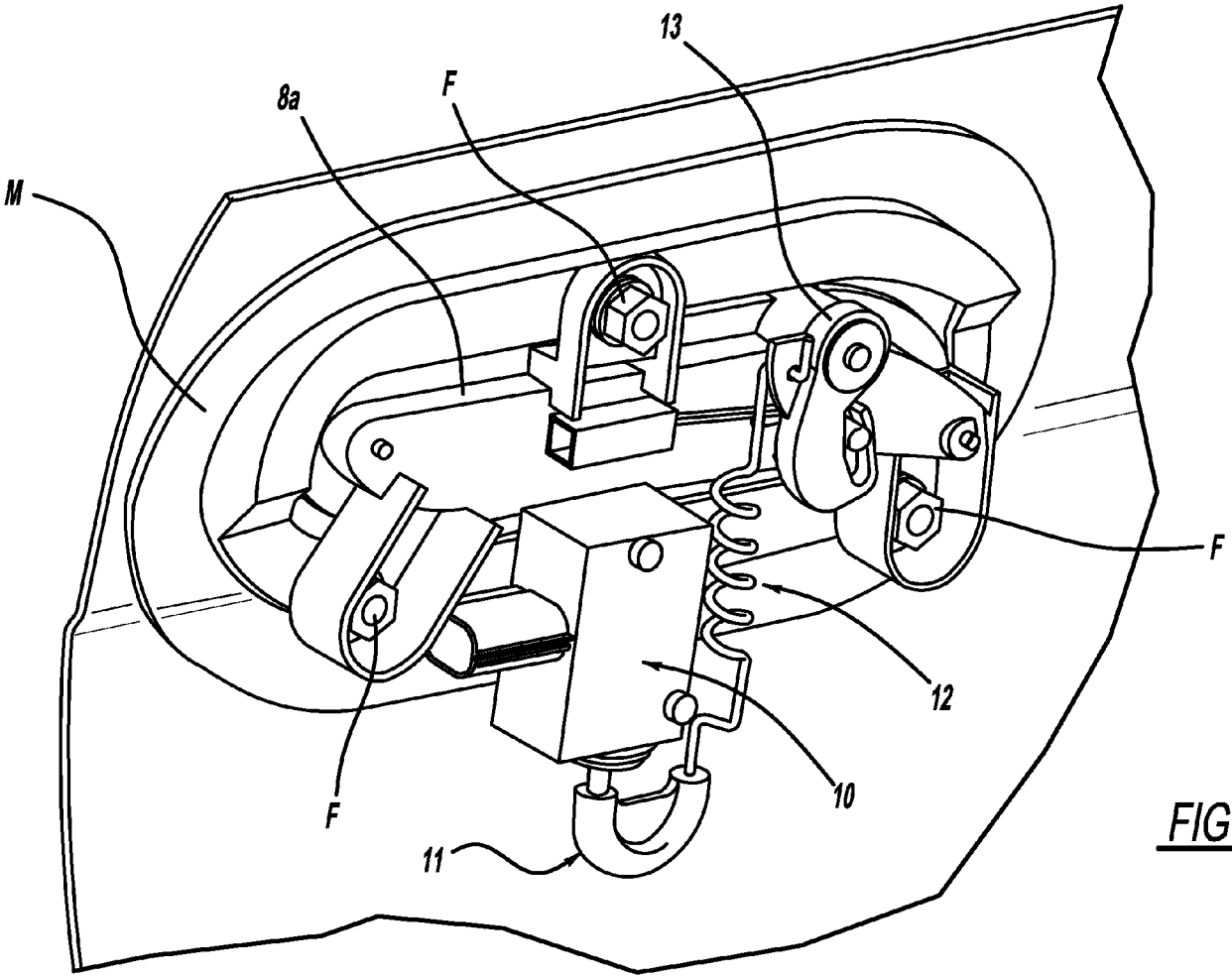
FIG. 5 is a detailed view of the interior of an exemplary vehicle door mounting the handle assembly of the present invention.

Referring next to FIGS. 4 and 5, the inventive handle assembly is depicted in an exemplary operational environment, according to which the handle assembly is secured (such as via fasteners F) to a mounting bracket M disposed on the interior of a vehicle door panel D (FIG. 5) so that the handle 1 is received through a generally correspondingly-shaped opening D1 in the door panel D to be, in the stowed position of the handle, generally flush with the exterior surface of the door panel D, as shown in FIG. 4).

Figure 6:
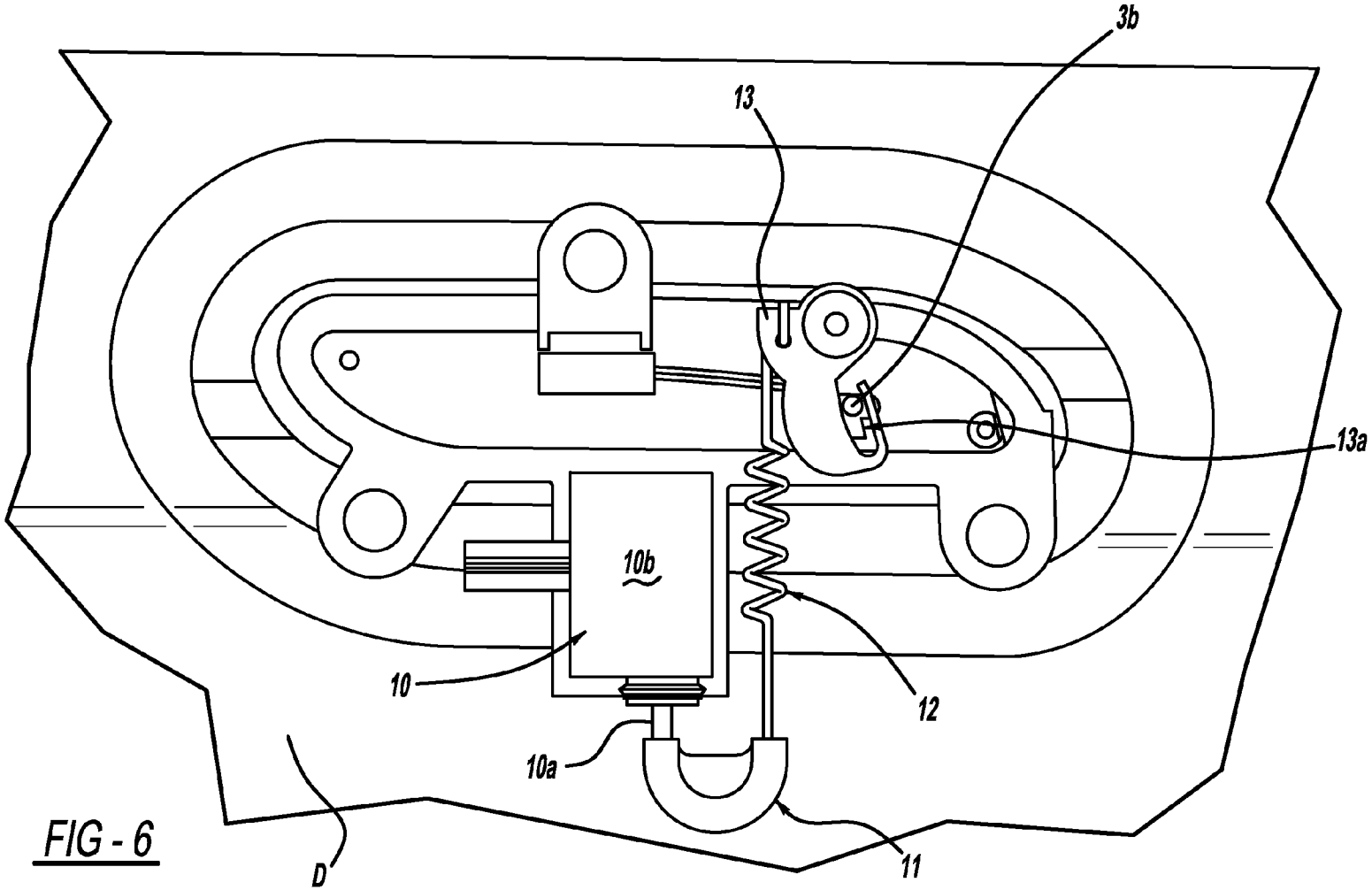
FIG. 6 depicts the handle assembly of FIG. 5, with the handle actuator assembly shown in the deployed condition of the handle.
Figure 7:
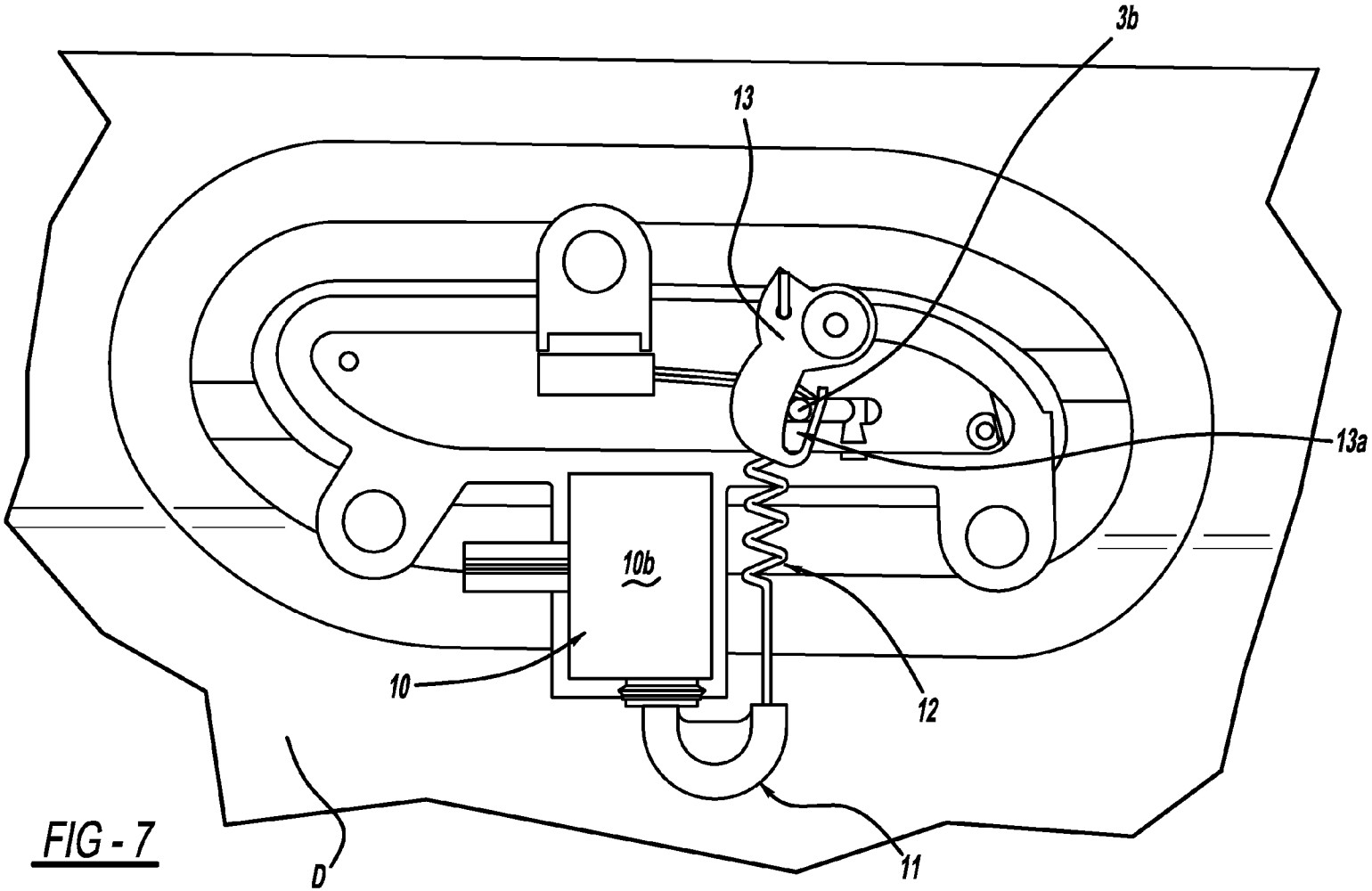
FIG. 7 depicts the handle assembly of FIG. 5, with the handle actuator assembly shown in the stowed condition of the handle.

Referring now to FIGS. 6 and 7, each of which depict the handle assembly from the perspective of the interior of the door panel D as shown in FIG. 5, operation of the present invention will be better understood.

According to FIG. 6 more particularly, the actuator assembly is shown in a condition corresponding to the stowed position of the handle 1 (FIG. 4). In this condition, the reciprocating pin 10*a* of motor 10 extends from the motor housing 10*b* so that the actuator member 10 is drawn downwardly relative to the handle 1 and, in turn, the bell-crank 13 is pivoted to a position in which stem portion 3*b* of the inner handle portion 3 extends generally perpendicular to the longitudinal axis of the slot 8*b*. Upon actuation of the motor 10 (such as, for instance, by operation of the sensor as heretofore described), reciprocating pin 10*a* is drawn upwardly toward the motor housing, which movement correspondingly urges actuator arm 11 upwardly, forcing bell-crank 13 to pivot clockwise (FIG. 7). As bell-crank 13 pivots clockwise, stem portion 3*b* of the inner handle portion 3, being captured in the first opening 13*a*, is urged rearwardly in the direction of travel of bell-crank 13. This motion forces handle 1 to pivot about pivot pin 9 so as to move into the deployed position of the handle, shown in FIG. 8.

Figure 9:
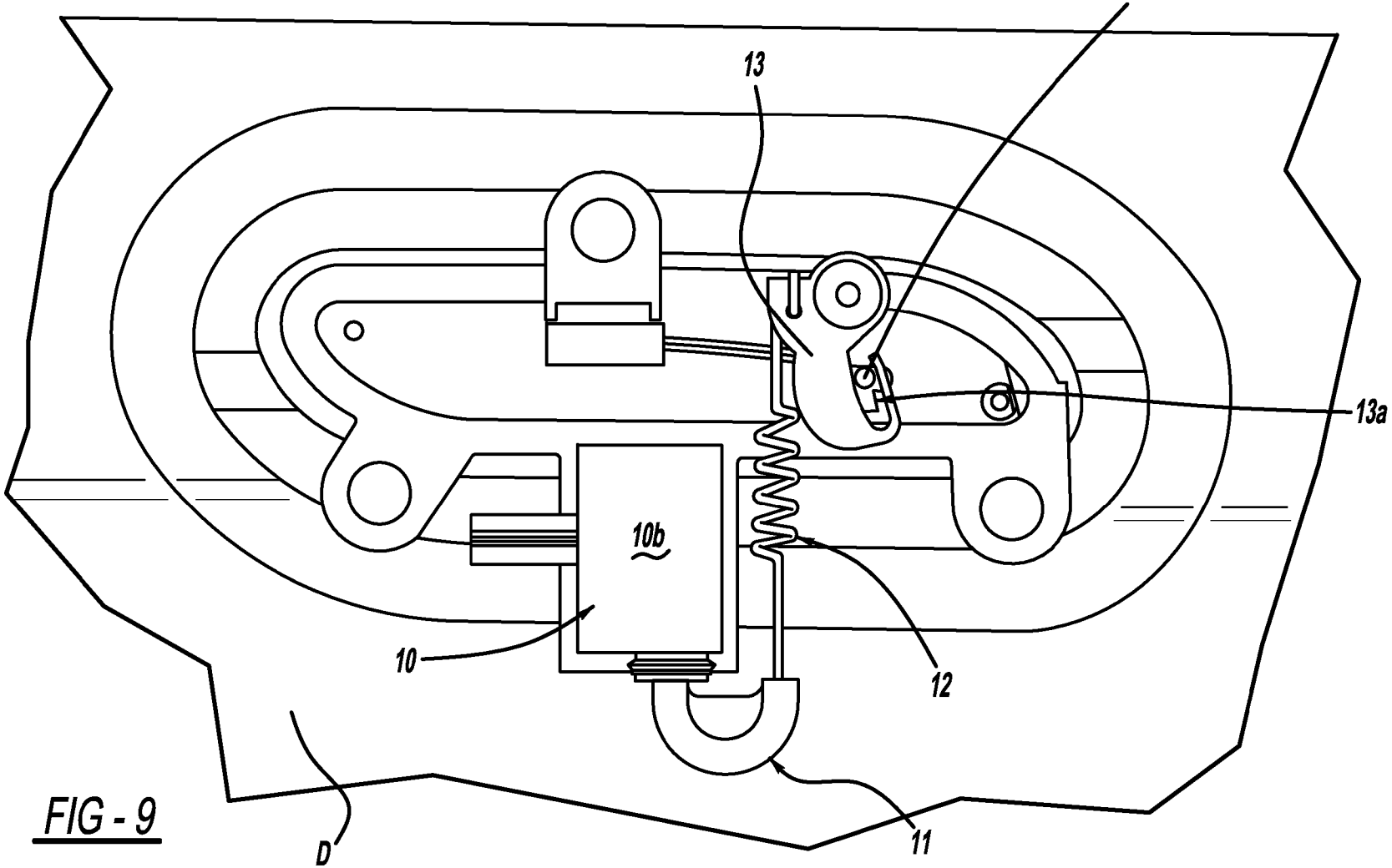
FIG. 9 depicts the handle assembly of FIG. 5, with the handle actuator assembly shown in the stowed condition of the handle.

In those circumstances where the handle is stuck in the stowed position by an external obstruction, such as may, for instance, be created by ice built-up around the handle on the exterior of the vehicle door, an individual leaning against the door and the door handle, etc., it is desirable to avoid damaging the motor 10 by continuing its operation against the overwhelming force of such an obstruction. To this end, the accumulator spring 12 serves to compress under the force of the motor if the handle fails to move by reason of being stuck in the stowed position. Preferably, the accumulator spring 12 is designed (dimensions and/or compression strength) so that it will be compressible for the entire period of operation of the motor 10, it being understood that, upon actuation thereof, the motor 10 is operated for only that period of time required to move the handle from one position (i.e., stowed or deployed) to the other. Thus, for instance, where the motor 10 is actuated with the handle 1 stuck in the stowed position, the motor will operate for a fixed period of time during which the accumulator spring 12 will continuously be compressed as it is loaded by the operation of motor 10. This compressed condition of the accumulator spring 12 is depicted in FIG. 9. Once the obstruction is removed from the handle 1, the loaded accumulator spring 12 is restored to its default condition. This action effects pivotal movement of the bell-crank 13 which, in turn, effects movement of the handle 1 to the deployed position in the manner heretofore described.

By virtue of the foregoing, it will be appreciated that Applicant has provided hereby a handle assembly for a vehicle door that is at once motor-operated and provides a simple yet robust means for addressing potential damage to the motor caused by the presence of an external obstruction preventing the handle from being moved from the stowed position thereof to the deployed position thereof.

The foregoing description of the exemplary embodiment of the invention has been presented for purposes of illustration and description. It is not intended to be exhaustive of, or to limit the invention to, the precise form disclosed, and modifications and variations thereof are possible in light of the above teachings or may be acquired from practice of the invention. The illustrated embodiment is shown and described in order to explain the principals of the innovation and its practical application so as to enable one skilled in the art to utilize the innovation in these and various additional embodiments and with various modifications as are suited to the particular use contemplated. Although only an exemplary embodiment of the present invention has been described in detail in this disclosure, those skilled in the art who review this disclosure will readily appreciate that many modifications are possible without materially departing from the novel teachings and advantages of the subject matter herein recited. Accordingly, all such modifications are intended to be included within the scope of the present innovations. Other substitutions, modifications, changes and omissions may be made in the design, operating conditions and arrangement of the exemplary embodiment without departing from the spirit of the present invention.

The invention claimed is:

1. A handle assembly for a vehicle door, comprising: a body supporting a handle that is pivotally moveable between a stowed position, in which the handle is not manually actuatable by a user, and a deployed position, in which the handle is manually actuatable by a user; and an actuator assembly comprising a motor and an actuator member interposed between the motor and the handle, the actuator member operably coupled to the handle and moveable by the motor to effect movement of the handle between the stowed and deployed positions thereof, and the actuator member having a spring accumulator that is compressed under the force of the motor, to thereby store energy of motion from the motor that would otherwise be transferred to the actuator member, when an external obstruction acts on the handle in the stowed position thereof to prevent the handle from being moved to the deployed position thereof.

2. The handle assembly of claim 1, wherein the handle is comprised of mateable outer and inner handle portions.

3. The handle assembly of claim 2, further comprising one or more sensors disposed between the mateable inner and outer handle portions.

4. The handle assembly of claim 3, wherein the one or more sensors include a capacitive sensor.

5. The handle assembly of claim 1, wherein, in the stowed position thereof, the handle is received in a recess provided in the body.

6. The handle assembly of claim 5, wherein the recess is surrounded by a gasket to seal the handle assembly against the interior of a vehicle door panel.

7. The handle assembly of claim 1, wherein the motor is disposed on the body.

8. The handle assembly of claim 1, wherein the actuator assembly comprises: a pin that is reciprocally driven by the motor, the actuator member being connected to the pin; a bell-crank pivotally secured to the body, the bell-crank connected to each of the actuator member and the handle.

9. The handle assembly of claim 8, wherein the bell-crank defines a first opening for slidably receiving therein a stem portion projecting away from the handle.

10. The handle assembly of claim 1, wherein the spring accumulator is a spring disposed along a length of the actuator.

11. A flush-mount handle assembly for a vehicle door of the type including a door panel having exterior and interior surfaces, and an opening therethrough for providing access to the handle assembly, the handle assembly comprising: a body adapted for securement to the interior surface of the vehicle door panel proximate the opening; a handle that is connected to the body and pivotally moveable relative thereto between a stowed position, in which the handle is disposed in close proximity to the body portion and the handle is not manually actuatable by a user, and a deployed position, in which the handle projects away from the body portion and the handle is manually actuatable by a user; and an actuator assembly comprising a motor and an actuator member interposed between the motor and the handle, the actuator member operably coupled to the handle and moveable by the motor to effect movement of the handle between the stowed and deployed positions thereof, and the actuator member having a spring accumulator that is compressed under the force of the motor, to thereby store energy of motion from the motor that would otherwise be transferred to the actuator member, when an external obstruction acts on the handle in the stowed position thereof to prevent the handle from being moved to the deployed position thereof.

12. The handle assembly of claim 11, wherein, in the stowed position thereof, the handle is received in a recess provided in the body.

13. The handle assembly of claim 12, wherein the recess is surrounded by a gasket to seal the handle assembly against the interior of the vehicle door panel.

14. The handle assembly of claim 11, wherein the motor is disposed on the body.

15. The handle assembly of claim 11, wherein the actuator assembly comprises: a pin that is reciprocally driven by the motor, the actuator member being connected to the pin; a bell-crank pivotally secured to the body, the bell-crank connected to each of the actuator member and the handle.

16. The handle assembly of claim 15, wherein the bell-crank defines a first opening for slidably receiving therein a stem portion projecting away from the handle.

17. The handle assembly of claim 11, wherein the spring accumulator is a spring disposed along a length of the actuator.

18. A handle assembly for a vehicle door of the type including a door panel having exterior and interior surfaces, and an opening therethrough for providing access to the handle assembly, the handle assembly comprising: a body securable to the interior surface of the vehicle door panel proximate the opening; a handle that is connected to the body and pivotally moveable relative thereto between a stowed position, in which the handle is disposed in close proximity to the body portion and the handle is not manually actuatable by a user, and a deployed position, in which the handle projects away from the body portion and the handle is manually actuatable by a user; and an actuator assembly comprising a motor, an actuator member having a first end operably coupled to the motor and a second end coupled to the handle via a bell-crank, the actuator member moveable by the motor to effect movement of the handle between the stowed and deployed positions thereof, and the actuator member having a spring accumulator that is compressed under the force of the motor, to thereby store energy of motion from the motor that would otherwise be transferred to the actuator member, when an external obstruction acts on the handle in the stowed position thereof to prevent the handle from being moved to the deployed position thereof.

19. The handle assembly of claim 18, wherein, in the stowed position thereof, the handle is received in a recess provided in the body.

20. The handle assembly of claim 18, wherein the spring accumulator is disposed between the first and second ends of the actuator.

* * * * *